US011656581B2

(12) United States Patent
Uematsu et al.

(10) Patent No.: US 11,656,581 B2
(45) **Date of Patent: *May 23, 2023**

(54) ELECTRONIC TIMEPIECE

(71) Applicant: CASIO COMPUTER CO., LTD., Tokyo (JP)

(72) Inventors: Daisuke Uematsu, Akishima (JP); Takashi Sano, Fussa (JP); Yohei Kawaguchi, Akishima (JP); Tatsumi Ichimura, Ome (JP); Takumi Yasuda, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/502,089

(22) Filed: Oct. 15, 2021

(65) Prior Publication Data

US 2022/0035318 A1 Feb. 3, 2022

Related U.S. Application Data

(62) Division of application No. 16/182,223, filed on Nov. 6, 2018, now Pat. No. 11,199,817.

(30) Foreign Application Priority Data

Nov. 7, 2017 (JP) ..... JP2017-215010

(51) Int. Cl.
*G04R 60/08* (2013.01)
*G04B 39/00* (2006.01)
(Continued)

(52) U.S. Cl.
CPC ..... *G04R 60/08* (2013.01); *G04B 39/00* (2013.01); *G04G 21/04* (2013.01); *G04R 20/02* (2013.01)

(58) Field of Classification Search
CPC ..... G04G 21/04; G04B 60/08; G04B 39/00; G04R 20/02; G04R 60/08
See application file for complete search history.

(56) References Cited

U.S. PATENT DOCUMENTS

2004/0145975 A1 7/2004 Barras et al.
2005/0219955 A1 10/2005 Xu et al.
(Continued)

FOREIGN PATENT DOCUMENTS

JP 2009168656 A 7/2009
JP 2019086415 A 6/2019

OTHER PUBLICATIONS

Japanese Office Action dated Mar. 22, 2022 (and English translation thereof) issued in Japanese Application No. 2021-033157.
(Continued)

*Primary Examiner* — Sean Kayes
(74) *Attorney, Agent, or Firm* — Holtz, Holtz & Volek PC

(57) ABSTRACT

An embodiment of an electronic timepiece includes a cylindrical exterior case, a bezel and a windshield member. In the exterior case, a circuit board is housed. The bezel is formed of a metal material to be ring-shaped, includes an inward flange part that projects from an inner side surface toward a center of the ring-shaped bezel, is arranged on an outer upper side of the exterior case and is electrically connected with the circuit board. The windshield member is formed of a transparent dielectric substance, arranged in the bezel and supported by the inward flange part. The bezel is configured to resonate with a radio wave having a desired frequency by adjustment of at least one of (i) a relative permittivity of the dielectric substance and (ii) an area of an overlap region where the inward flange part and the windshield member overlap each other.

9 Claims, 7 Drawing Sheets

(51) Int. Cl.

| | |
|---|---|
| *G04G 21/04* | (2013.01) |
| *G04R 20/02* | (2013.01) |

(56) References Cited

U.S. PATENT DOCUMENTS

| | | | | |
|---|---|---|---|---|
| 2012/0320715 | A1 | 12/2012 | Maruyama | |
| 2014/0240181 | A1 | 8/2014 | Mamuro et al. | |
| 2015/0188217 | A1 | 7/2015 | Tsai et al. | |
| 2017/0018842 | A1* | 1/2017 | Sano | H01Q 9/0407 |
| 2017/0269553 | A1* | 9/2017 | Kadmiri | G04B 23/028 |
| 2017/0358850 | A1* | 12/2017 | Vanjani | G06F 1/1656 |
| 2018/0128924 | A1* | 5/2018 | Wu | H01Q 1/38 |
| 2018/0287248 | A1 | 10/2018 | Han et al. | |
| 2022/0035318 | A1 | 2/2022 | Uematsu et al. | |

OTHER PUBLICATIONS

Notice of Allowance dated Jul. 16, 2021 issued in U.S. Appl. No. 16/182,223.
Office Action (Non-Final Rejection) dated Mar. 29, 2021 issued in U.S. Appl. No. 16/182,223.

* cited by examiner

FIG.10
| MATERIAL FOR WINDSHIELD MEMBER | RELATIVE PERMITTIVITY $\varepsilon_r$ | DIELECTRIC LOSS $\tan\delta \times 10^{-4}$ |
|---|---|---|
| SUPER WHITE GLASS | 7 | 36 |
| SAPPHIRE | 10 | 0.001 |
FIG.11
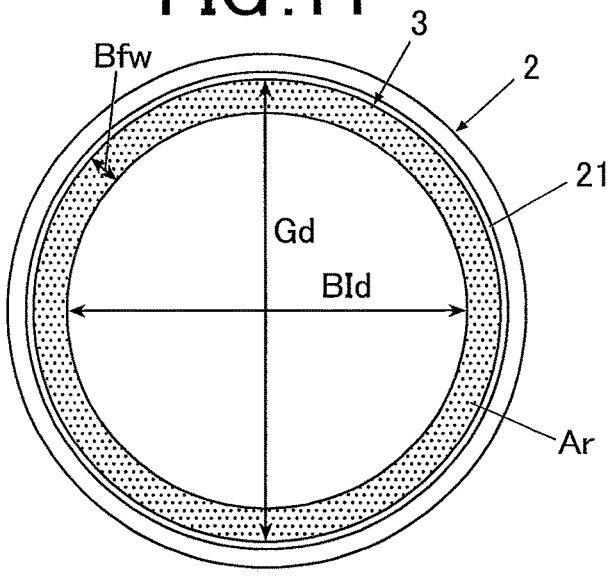
FIG.12
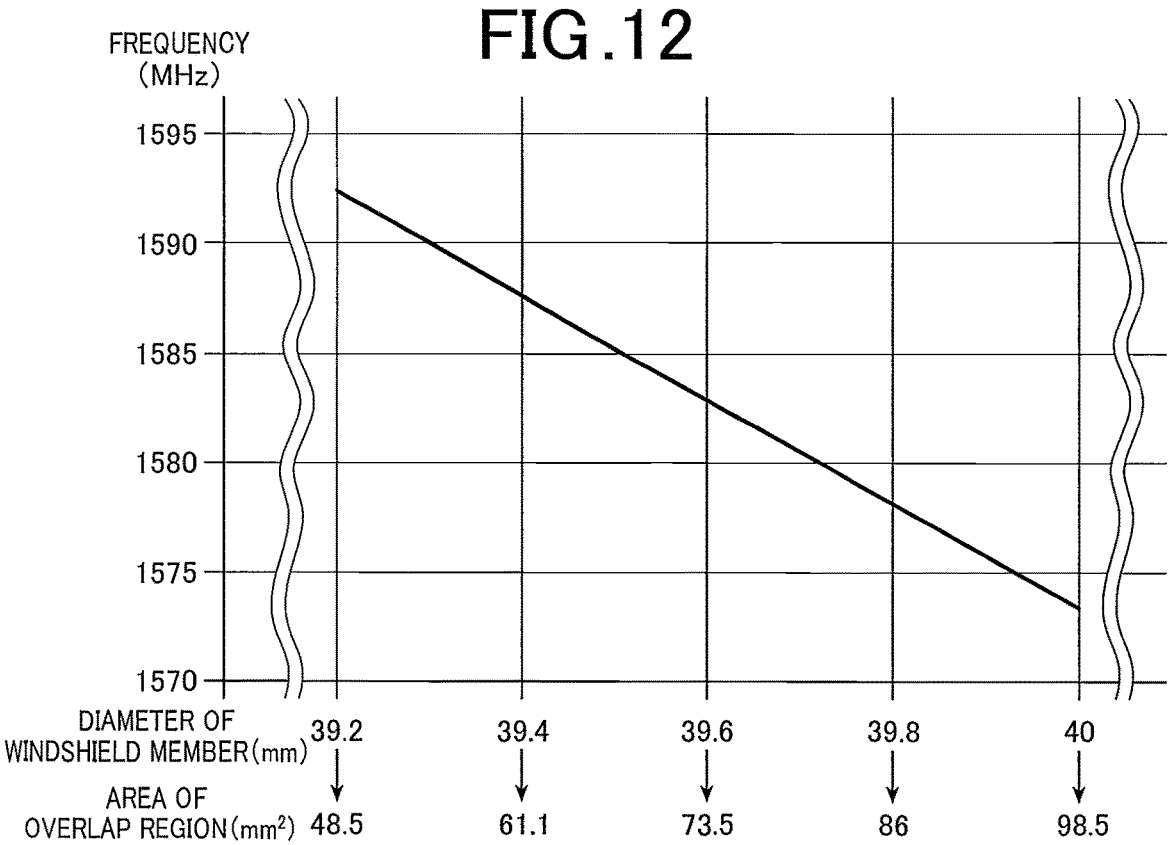

ELECTRONIC TIMEPIECE

CROSS-REFERENCE TO RELATED APPLICATIONS

This application is a Divisional Application of U.S. application Ser. No. 16/182,223, filed on Nov. 6, 2021, which is based upon and claims the benefit of priority from the prior Japanese Patent Application No. 2017-215010, filed on Nov. 7, 2017, the entire contents of all of which are incorporated herein by reference.

BACKGROUND

1. Technical Field

The technical field relates to an electronic timepiece.

2. Description of the Related Art

There is known an electronic timepiece, such as a watch, which receives satellite radio waves to acquire accurate time information, position information and so forth. (Refer to, for example, JP 2009-168656 A.)

The electronic timepiece described in JP 2009-168656 A has a dial as ground and an antenna arranged at a concealing portion between the dial and a windshield member (cover glass).

The configuration described in JP 2009-168656 A makes the timepiece as a whole thick because the antenna is arranged on the dial.

In particular, if the antenna is large to receive radio waves having a desired frequency, a timepiece case also needs to be large, so that the electronic timepiece is large.

Further, because the dial is used as the ground, the dial needs to be formed of a metal material, for example. Hence, the range of choice about material and arrangement of the dial is limited, for example.

SUMMARY

An electronic timepiece is disclosed herein.

An electronic timepiece according to a preferred embodiment includes: a cylindrical exterior case in which a circuit board is housed; a bezel which is formed of a metal material to be ring-shaped, includes an inward flange part that projects from an inner side surface of the ring-shaped bezel toward a center of the ring-shaped bezel, is arranged on an outer upper side of the exterior case, and is electrically connected with the circuit board; and a windshield member which is formed of a transparent dielectric substance, arranged in the bezel, and supported by the inward flange part, wherein the bezel is configured to resonate with a radio wave having a desired frequency by adjustment of at least one of (i) a relative permittivity of the dielectric substance which forms the windshield member and (ii) an area of an overlap region where the inward flange part and the windshield member overlap each other.

BRIEF DESCRIPTION OF THE DRAWINGS

The accompanying drawings, which are incorporated in and constitute apart of the specification, illustrate embodiments of the present invention, and together with the general description given above and the detailed description of the embodiments given below, serve to explain the principles of the present invention, wherein:

FIG. 10 is a table showing a relationship between material, relative permittivity and dielectric loss of a windshield member;

FIG. 11 is a schematic view to explain overlap of the bezel and the windshield member; and FIG. 12 is a graph showing a relationship between an overlap region of the bezel and the windshield member and frequency.

DETAILED DESCRIPTION

Hereinafter, an embodiment(s) is described in detail with reference to the drawings. In the embodiment(s), a watch having a bezel as an exterior member having an antenna function is described as an electronic timepiece. However, the scope of the present invention is not limited to the embodiment(s) or illustrated examples.

Figure 1:
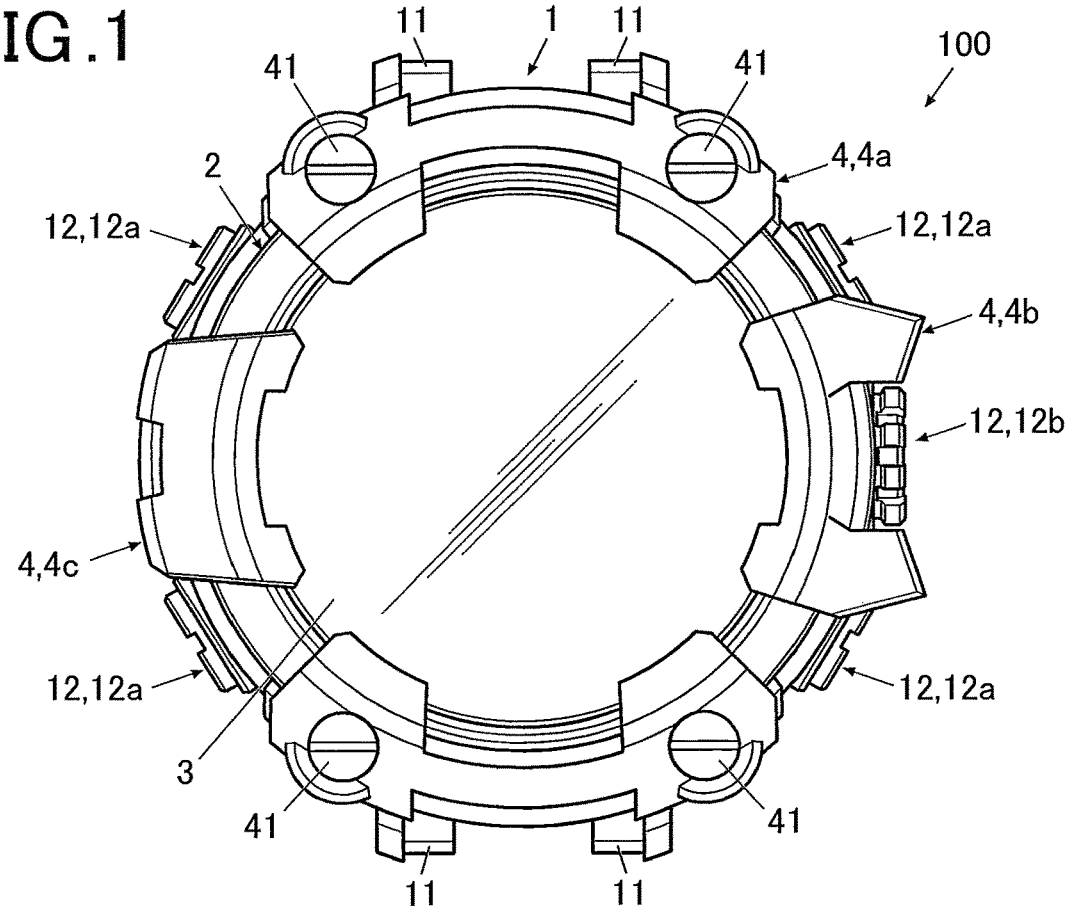
FIG. 1 is a front view of an electronic timepiece according to an embodiment(s)

FIG. 1 is a front view of an electronic timepiece according to an embodiment(s).

As shown in FIG. 1, an electronic timepiece 100 includes a case (hereinafter referred to as "exterior case 1").

The exterior case 1 is formed of hard resin, such as an ABS resin.

The material for forming the exterior case 1 is not limited to resin. Usable examples thereof include: metal including stainless steel and titanium; ceramic; and other various materials.

As described below, in this embodiment, on the upper side of the exterior case 1, a bezel 2 which functions as an antenna is mounted. Hence, if the exterior case 1 is formed of a conductive material, such as a metal material, it is preferable that an insulating low-loss resin or the like which has a certain level of relative permittivity and does not greatly change frequency characteristics of the bezel 2 as an antenna be interposed between the exterior case 1 and the bezel 2 in order to insulate the exterior case 1 and the bezel 2 from one another.

Even if the exterior case 1 is formed of a resin material, a reinforcing material may be mixed with the resin material so that the exterior case 1 can have strength. In this case, it is preferable that a nonconductive material, such as glass fiber, be used as the reinforcing material.

Figure 2:
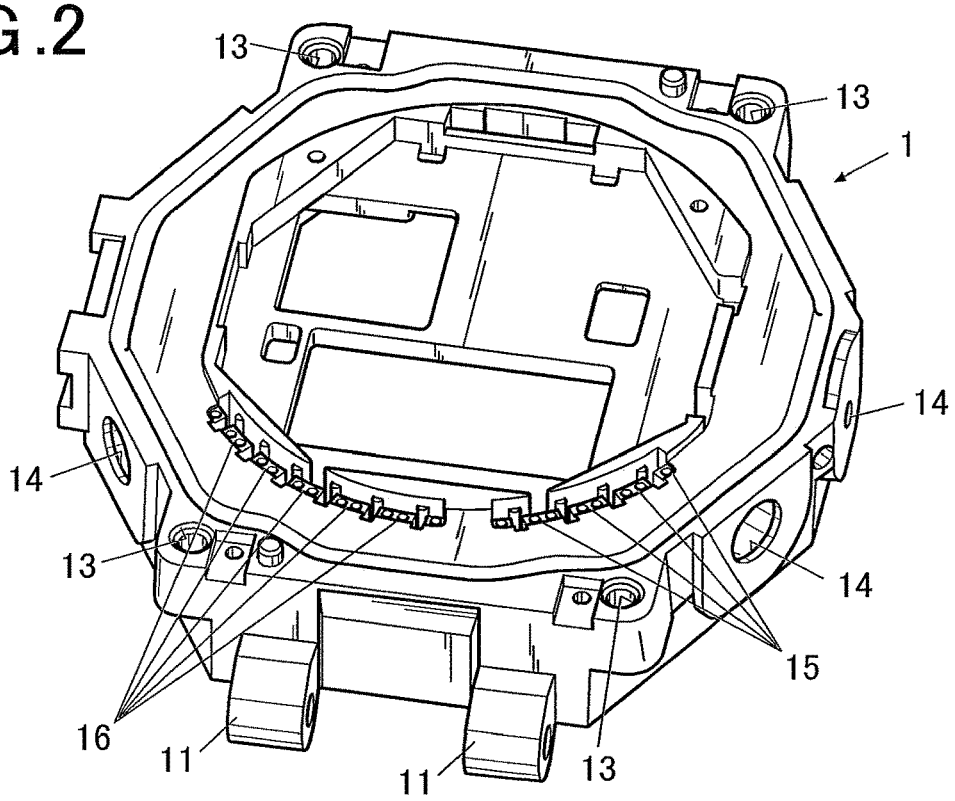
FIG. 2 is a perspective view of an exterior case of the electronic timepiece viewed from a visible side.
Figure 3:
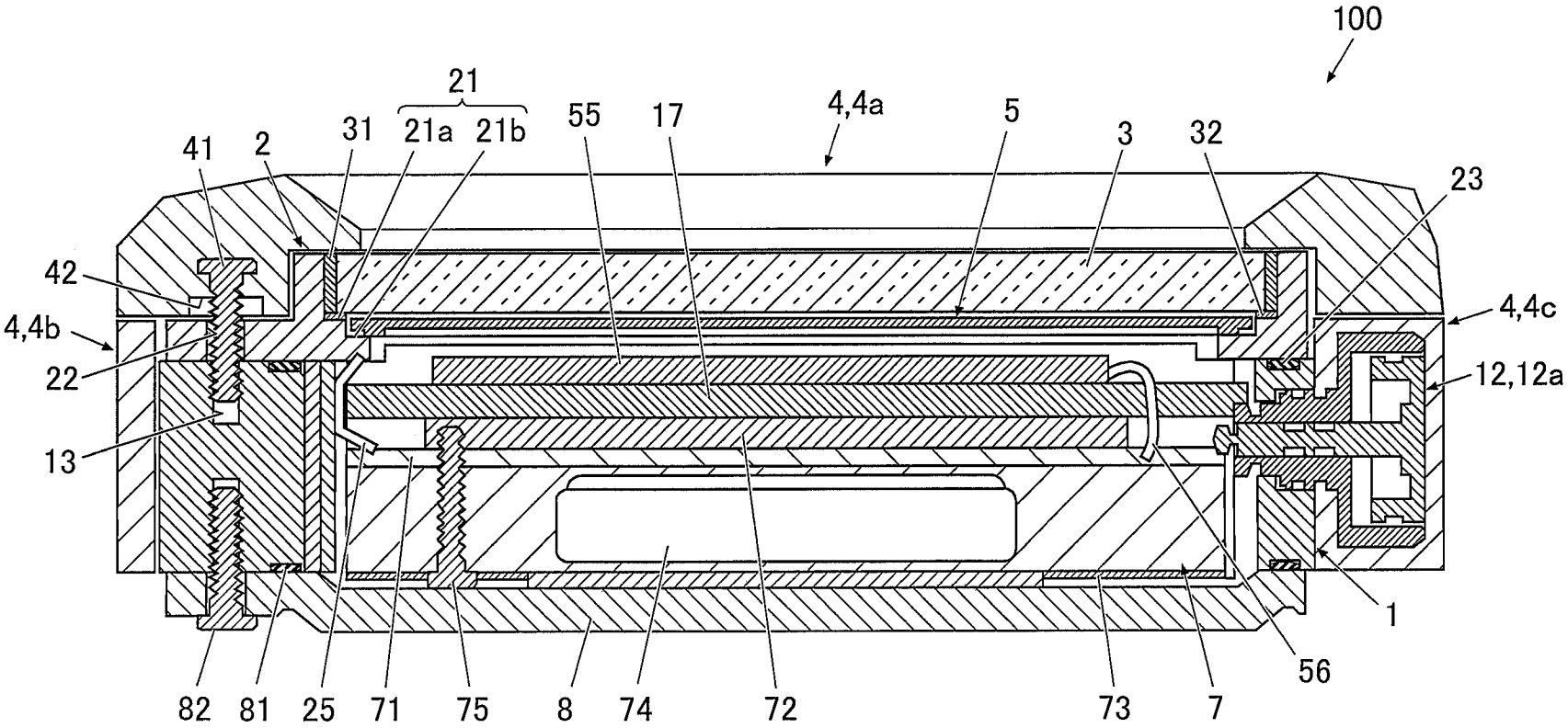
FIG. 3 is a sectional side view of the electronic timepiece shown in FIG. 1.

FIG. 2 is a perspective view of the exterior case 1. FIG. 3 is a sectional side view of the electronic timepiece 100 of this embodiment.

As shown in FIG. 2, the exterior case 1 is approximately cylindrical. The upper side and the lower side of the exterior case 1 in its thickness direction (the up-down direction in FIG. 3) are opened such that the exterior case 1 is hollow. This hollow portion serves as storage space where various components are housed.

At both ends in the up-down direction in FIG. 1 (at 12 o'clock and 6 o'clock in an analog timepiece) of the exterior case 1, belt attachment parts 11 are formed. To the belt attachment parts 11, a not-shown timepiece belt(s) can be attached.

Further, as described below, the bezel 2 and a buffer member 4 (4*a* to 4*c*) are fixed to the exterior case 1 with screws or the like. At points on the exterior case 1 corresponding to screw insertion positions, holes 13 are formed. (Refer to FIG. 2 and FIG. 3.)

On the outer circumferential surface of the exterior case 1, operation buttons 12 (operation buttons 12*a* and 12*b*) to input various operation instructions, such as instructions for time adjustment, are arranged. At the positions on the exterior case 1 for the operation buttons 12, through holes 14 through the exterior case 1 are formed.

Figure 4:
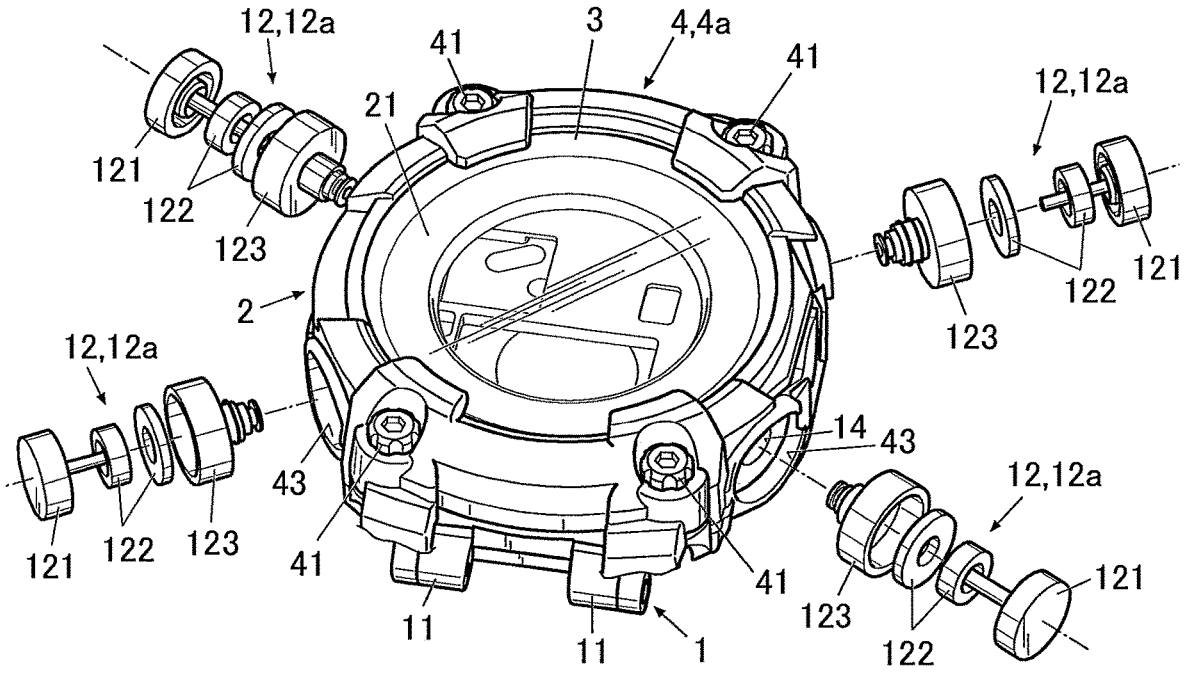
FIG. 4 is a partially exploded perspective view showing configuration of each operation button part of the electronic timepiece shown in FIG. 1.
Figure 5:
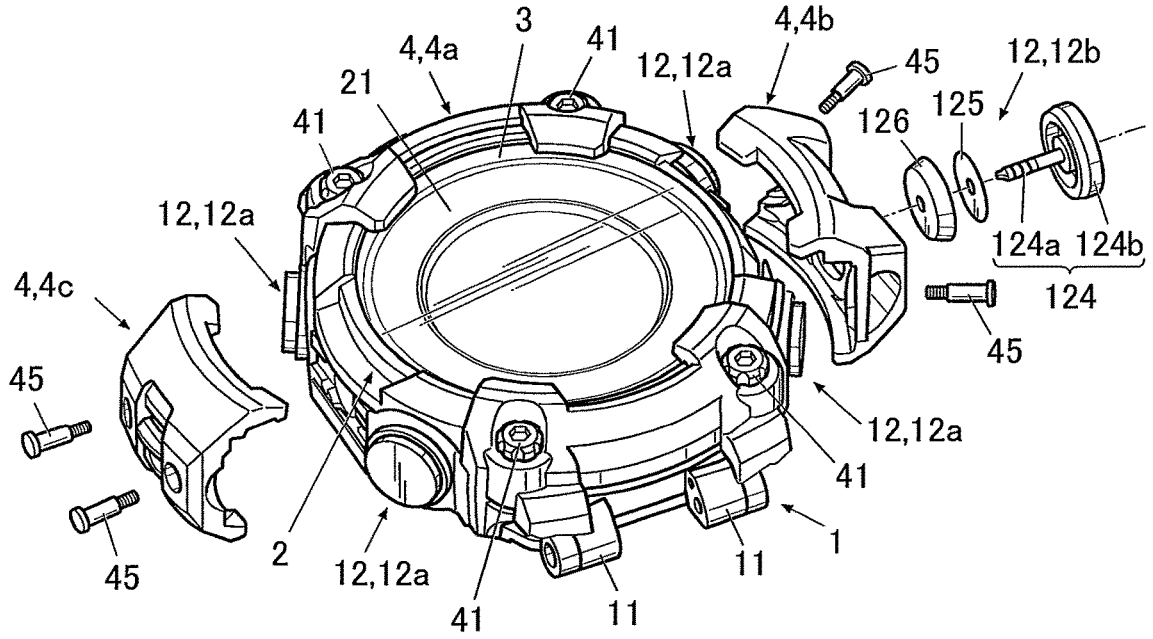
FIG. 5 is a partially exploded perspective view showing configuration of an operation button part and a buffer member of the electronic timepiece shown in FIG. 1.

FIG. 4 and FIG. 5 are partially exploded perspective views showing configuration of each operation button 12.

As shown in FIG. 4, the electronic timepiece 100 of this embodiment has the operation buttons 12*a* which are push buttons arranged at positions for approximately 2 o'clock, 4 o'clock, 8 o'clock and 10 o'clock in an analog timepiece.

Each push operation button 12*a* includes a body 121 which is operated by a user with his/her finger, a buffer member 122 which serves as a cushion and absorbs impact or the like when the operation button 12*a* is operated, and a button pipe 123 which holds the body 121 in a state in which the body 121 is housed in the button pipe 123.

The tip of the button pipe 123 is inserted into the exterior case 1 from the through hole 14, and when the body 121 of the operation button 12*a* is operated, this operation is transmitted to timepiece modules or the like arranged in the exterior case 1.

As shown in FIG. 5, the electronic timepiece 100 of this embodiment has the operation button 12*b* which is a winding crown arranged at a position for approximately 3 o'clock in an analog timepiece.

The winding operation button 12*b* includes a body 124, a spacer 125 and a buffer member 126 which serves as a cushion and absorbs impact when the operation button 12*b* is operated.

The body 124 includes a shaft part 124*a* one end of which is inserted into the exterior case 1 from the through hole 14, and a head part 124*b* which is arranged on the other end of the shaft part 124*a* and operated by a user with his/her finger.

When the body 124 of the operation button 12*b* is rotationally operated by a user, this operation is transmitted to the timepiece modules or the like arranged in the exterior case 1.

As shown in FIG. 3, in the storage space of the exterior case 1, various modules (timepiece modules) for the electronic timepiece 100 to function as a timepiece are housed. The various modules includes: a housing 7 in which a battery (cell) 74 and so forth are arranged; a circuit board (circuit board 71) arranged on the upper surface of the housing 7; a pressing plate 73 which suppresses ricketiness of components, such as the circuit board 71; and a liquid crystal panel 55 as a display.

The housing 7, the circuit board 71 and so forth are fixed with a screw(s) 75 so that their unsteadiness, dislocation and so forth in the exterior case 1 are prevented.

The liquid crystal panel 55 is placed on a panel placement part 17 formed in the exterior case 1, and electrically connected with the circuit board 71 via a wiring member 56 constituted of a flexible wiring circuit board or the like.

The liquid crystal panel 55 displays various types of information, such as time, a date, a day of a week and position information. In this embodiment, the liquid crystal panel 55 is exposed to the visible side via a ring-shaped dial 5, which is described below, to be visible through a windshield member 3 (cover glass, to be specific).

The display is not limited to the liquid crystal panel 55. Examples usable as the display include various display units made of, for example, organic EL (ElectroLuminescence).

The circuit board 71 is a circuit to receive radio waves with an antenna, and provided with a functional component set 72 constituted of various circuits including an antenna circuit, electronic components, and so forth all of which are not shown.

Figure 6:
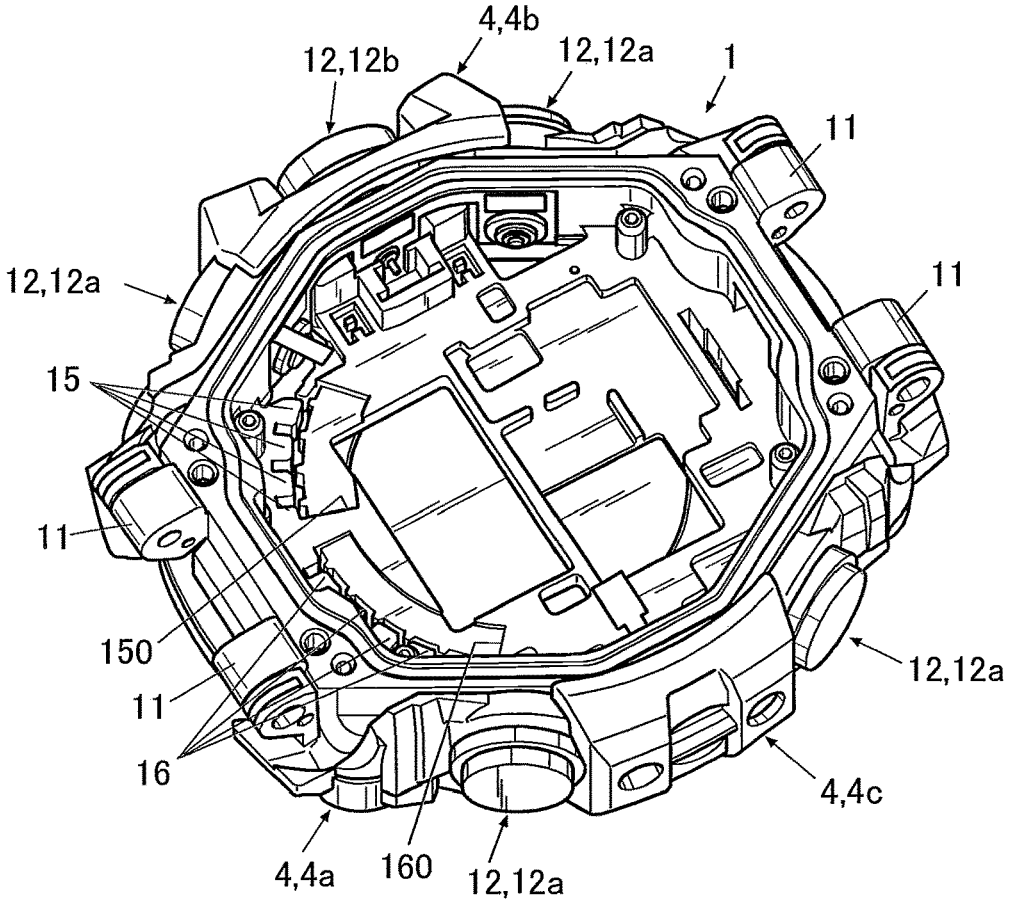
FIG. 6 is a perspective view of the electronic timepiece viewed from the back surface side with internal components removed.

FIG. 6 is a perspective view of the exterior case 1 viewed from the back surface side (an invisible side or the lower side in FIG. 3), the exterior case 1 shown in FIG. 2 being reversed.

As shown in FIG. 2 and FIG. 6, at or near a position which is on the outer edge portion of the exterior case 1 and corresponds to the antenna circuit mounted on the circuit board 71, a notched part 150 and circuit connection hole parts 15 are provided to insert a connecting member 25 which electrically connects the below-described bezel 2 with the circuit board 71.

Although the position and shape of the notched part 150, the number and arrangement of the circuit connection hole parts 15 to be provided, and so forth are not particularly limited, in this embodiment, the notched part 150 which is approximately arc-shaped along the shape of the outer edge of the exterior case 1 is formed at a position for 4 o'clock to 5 o'clock in an analog timepiece, and four circuit connection hole parts 15 are formed next to one another along a side of the notched part 150 close to the outer circumference of the exterior case 1.

Further, at a position which is on the outer edge portion of the exterior case 1 and is different from the position of the notched part 150 and the circuit connection hole parts 15, a notched part 160 and ground connection hole parts 16 are provided to insert a not-shown ground terminal which connects the bezel 2 to the ground.

Although the position and shape of the notched part 160, the number and arrangement of the ground connection hole parts 16 to be provided, and so forth are not particularly limited, in this embodiment, the notched part 160 which is approximately arc-shaped along the shape of the outer edge of the exterior case 1 is formed at a position for 7 o'clock to 8 o'clock in an analog timepiece, and five ground connection hole parts 16 are formed next to one another along a side of the notched part 160 close to the outer circumference of the exterior case 1.

As shown in FIG. 3, to the lower side (back surface) of the exterior case 1 (the lower side in FIG. 3 or the invisible side), a back cover member 8 as a closing member which closes the opening in the back surface of the exterior case 1 is attached via a waterproof ring 81. The back cover member 8 is formed of a metal material, such as stainless steel or titanium, for example.

The material for forming the back cover member 8 is not limited to those exemplified herein. Usable examples thereof include various resin materials including an ABS resin.

The back cover member 8 is fixed to the exterior case 1 with a screw 82.

On the outer upper side of the exterior case 1 (the upper side in FIG. 3, the visible side or the front surface side), the bezel 2 is arranged.

In this embodiment, the bezel 2 is configured to resonate with radio waves having a desired frequency, and functions as an antenna.

It is preferable that the radio waves having a desired frequency receivable by the bezel 2, which functions as an antenna, include radio waves transmitted from satellites.

For example, radio waves transmitted from GPS (Global Positioning System) satellites and radio waves transmitted from QZSS (Quasi-Zenith Satellite System), which are quasi-zenith satellites of Japan, have a frequency of 1575.42 MHz, and radio waves transmitted from GLONASS (GLObal NAvigation Satellite System) have a frequency band the center frequency of which is 1602.5625 MHz.

In this embodiment, the bezel 2 is made to function as an antenna which can receive radio waves having a desired frequency by appropriate setting of various conditions about the bezel 2, the below-described windshield member 3 and so forth.

For example, if the bezel 2 is configured to resonate with radio waves having a frequency of 1575.42 MHz for GPS and so forth and/or radio waves having a frequency of 1602.5625 MHz for GLONASS, the bezel 2 can receive radio waves transmitted from GPS and/or GLONASS. Consequently, the electronic timepiece 100 can make use of time information and position information contained in these radio waves.

The radio waves having a desired frequency receivable by the bezel 2, which functions as an antenna, are not limited to the radio waves transmitted from GPS satellites and so forth described above.

In this embodiment, the bezel 2 is formed of a metal material, such as SUS316 (stainless steel 316), to be ring-shaped, for example.

The material for forming the bezel 2 is not limited to SUS316.

However, in this embodiment, as described above, the bezel 2 is configured to function as an antenna which resonates with radio waves having a desired frequency. From this point, it is considered that if conductivity of the material forming the bezel 2 is low (resistivity thereof is high), sufficient antenna gain cannot be obtained.

To make the bezel 2 function as an antenna having excellent antenna gain, it is preferable to use, as the material for forming the bezel 2, a metal material having a certain level of conductivity or higher (i.e. having a certain level of resistivity or lower) and a certain level of magnetic permeability or lower.

From this point, as the material for forming the bezel 2 of this embodiment, for example, the following metal materials can be used: the abovementioned SUS316 (resistivity (μΩ·cm) of 74); SUS304 (resistivity (μΩ·cm) of 72); silver (resistivity (μΩ·cm) of 1.62); copper (resistivity (μΩ·cm) of 1.72); titanium (Ti) (resistivity (μΩ·cm) of 55); Nichrome (alloy of Ni, Fe and Cr) (resistivity (μΩ·cm) of 109); and Ti64 (resistivity (μΩ·cm) of 166). The above metal materials have a magnetic permeability (relative magnetic permeability) of about 1.

The material for forming the bezel 2 should be appropriately selected in accordance with the frequency of radio waves desired to be received by the bezel 2 as an antenna and other various conditions, and hence is not limited to those exemplified herein.

Figure 7:
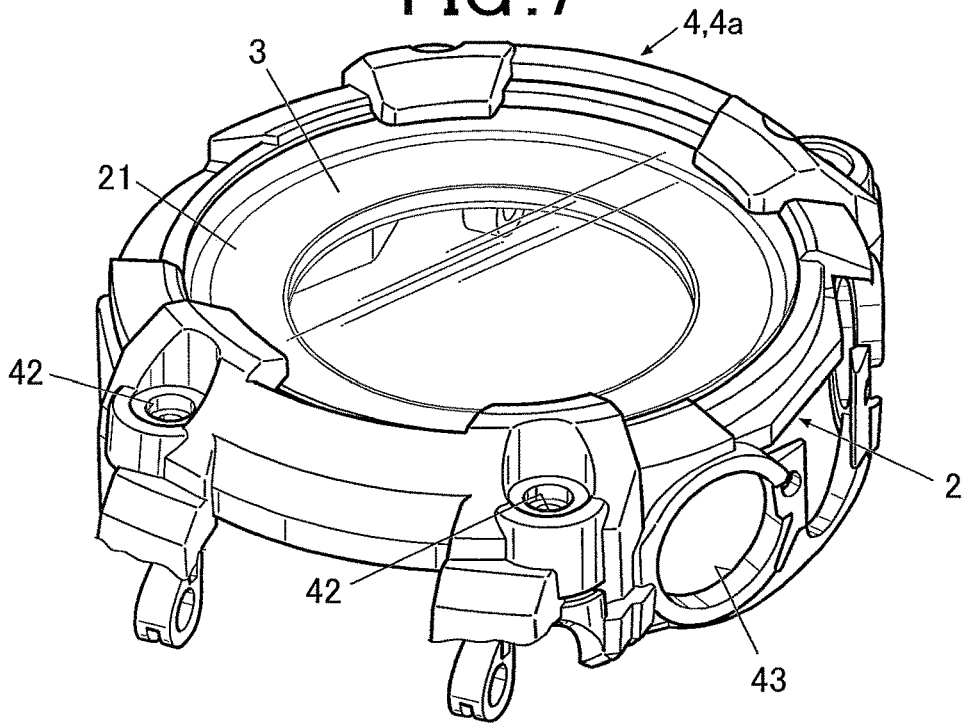
FIG. 7 is a perspective view showing a state in which first buffer members are attached to a bezel.
Figure 8:
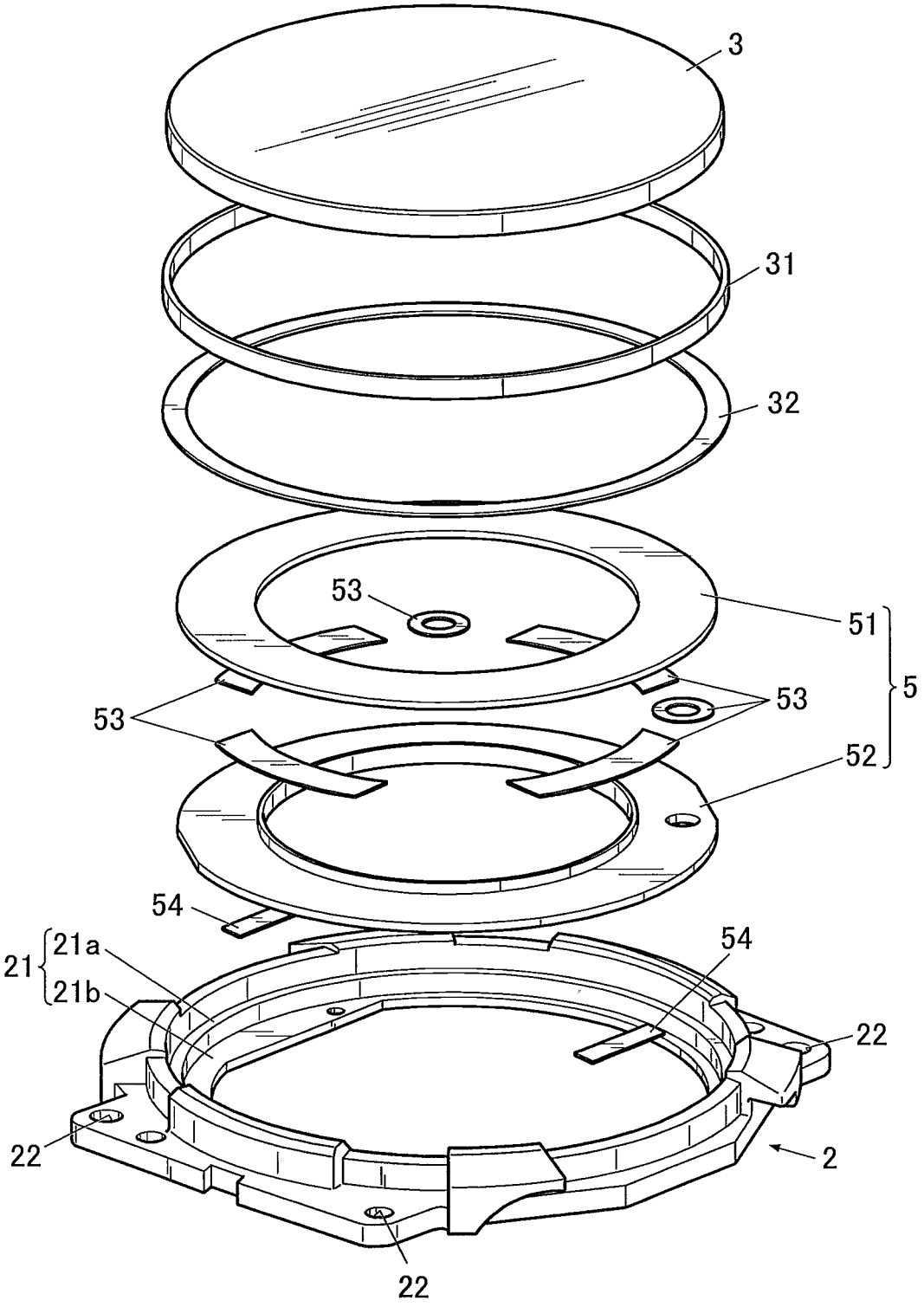
FIG. 8 is an exploded perspective view showing the bezel and components to be fitted into the bezel according to the embodiment.

FIG. 7 is a perspective view showing the bezel 2 and components surrounding the bezel 2. FIG. 8 is an exploded perspective view showing the bezel 2 and components to be arranged in the bezel 2.

As shown in FIG. 7 and FIG. 8, the bezel 2 has an inward flange part 21 which projects from the inner side surface (inner circumferential surface) of the ring-shaped bezel 2 toward the center of the ring-shaped bezel 2.

The inward flange part 21 of this embodiment includes: a first stage flange 21*a;* and a second stage flange 21*b* which is formed on a further lower side than the first stage flange 21*a* (the lower side in FIG. 8) and projects further toward the center of the ring-shaped bezel 2 than the first stage flange 21*a*.

On the upper surface (the surface on the upper side in FIG. 8) of the second stage flange 21*b,* the outer edge of the dial 5 is placed.

The dial 5 of this embodiment includes an upper dial 51 and a lower dial 52 which are adhesively fixed to one another with an adhesive member 53 constituted of, for example, a double-sided tape not to be dislocated, thereby being integrated with one another.

The lower surface of the dial 5 (the back surface of the lower dial 52) is adhesively fixed to the upper surface of the second stage flange 21*b* with an adhesive member 54 constituted of a double-sided tape or the like so that the dial 5 is not dislocated.

On the upper surface (the surface on the upper side in FIG. 8) of the first stage flange 21*a,* the outer edge of the windshield member 3 is placed via a spacer 32.

If a component under the windshield member 3 (the dial 5, in this embodiment) is not sufficiently fixed, the component may contact or stick to the lower surface of the windshield member 3. The spacer 32 is for preventing this situation from happening and catches the outer edge of the windshield member 3.

It is preferable that the spacer 32 be subjected to glass printing or the like so as to be invisible from the outside.

The spacer 32 is formed of PET (PolyEthylene Terephthalate, i.e. a PET resin), for example. Although its forming method is not particularly limited, a method of cutting out a pattern from (i.e. punching out in) a PET sheet can be used, for example.

In addition to the forming method, the material for forming the spacer 32 is not particularly limited, either.

Usable examples as the spacer 32 include double-sided tapes having a certain level of hardness, components molded from an ABS resin, a polycarbonate (PC) resin and so forth, and components formed of various metal materials.

In the bezel 2 (the first stage flange 21*a* of the bezel 2, in this embodiment), a waterproof ring 31 is arranged. The windshield member 3 is press-fitted into the bezel 2 with the waterproof ring 31 in between, so that the windshield member 3 is fitted in and fixed to the ring-shaped bezel 2, and is supported by the inward flange part 21 (the first stage flange 21*a,* in this embodiment).

Configuration of the inward flange part 21 is not limited to that exemplified herein.

For example, the exterior case 1 may have a supporting part which supports the dial 5, and the inward flange part 21 may be a flange part having only one stage (corresponding to the first stage flange 21*a* in this embodiment) which supports the windshield member 3.

The windshield member 3 is formed of a transparent material and is a cover glass which covers the visible side of the electronic timepiece 100. The windshield member 3 is supported by the inward flange part 21 of the bezel 2.

In this embodiment, the windshield member 3 is formed of a dielectric substance. Examples thereof include various types of glass including super white glass, and sapphire (transparent synthetic sapphire).

In this embodiment, the bezel 2 is made to function as an antenna. Hence, use of the dielectric substance as the material for forming the windshield member 3, which is contiguous with the bezel 2, can promise increase in antenna gain of the bezel 2 as an antenna.

In this embodiment, the bezel 2 is configured to resonate with radio waves having a desired frequency, namely, to function as an antenna which resonates with radio waves having a desired frequency, by adjustment of at least one of (i) the relative permittivity of the dielectric substance which forms the windshield member 3 and (ii) the area of an overlap region where the inward flange part 21 (the first stage flange 21*a* of the bezel 2, in this embodiment) and the windshield member 3 overlap each other.

A method for adjusting the frequency receivable by the bezel 2 is described below in detail.

As shown in FIG. 4, FIG. 5 and so forth, the electronic timepiece 100 of this embodiment further includes the buffer member 4 which partially or entirely covers the bezel 2.

The buffer member 4 can be formed of resin, such as a urethane resin.

As described above, in this embodiment, the bezel 2 is made to function as an antenna. Hence, it is preferable that the buffer member 4 which contacts the bezel 2 be formed of a nonconductive low-loss (dielectric loss (tanδ)) material in order not to block the function of the bezel 2 as an antenna.

The electronic timepiece 100 of this embodiment includes, as the buffer member 4, first buffer members 4*a* which cover portions of the bezel 2 for 12 o'clock and 6 o'clock in an analog timepiece, a second buffer member 4*b* which covers a portion of the bezel 2 for 3 o'clock in an analog timepiece, and a third buffer member 4*c* which covers a portion of the bezel 2 for 9 o'clock in an analog timepiece.

In each of the first buffer members 4*a* which respectively cover the portions for 12 o'clock and 6 o'clock in an analog timepiece, two screw holes 42 to insert screws 41 are formed.

As shown in FIG. 3, the screws 41 are inserted from the screw holes 42 formed in the first buffer members 4*a* into the holes 13 formed in the exterior case 1 via screw holes 22 formed in the bezel 2, so that the bezel 2 and the buffer member 4 (the first buffer members 4*a*, in this embodiment) are screwed to the exterior case 1.

On the first buffer members 4*a*, at the positions where the operation buttons 12 (12*a*) are arranged, holes 43 to insert the operation buttons 12 (12*a*) into the exterior case 1 are formed.

On the second buffer member 4*b*, at the position where the operation button 12 (12*b*) is arranged, a not-shown hole to insert the operation button 12 (12*b*) into the exterior case 1 is formed.

The second buffer member 4*b* and the third buffer member 4*c* are fixed (screwed) to the exterior case 1 with screws 45, and at the positions where the screws 45 are inserted, not-shown screw holes are formed.

Configuration of the buffer member 4 is not limited to that exemplified herein. For example, the buffer member 4 may be formed to be continuous, not being divided. Further, the buffer member 4 may entirely cover the bezel 2.

Hereinafter, configuration to electrically connect the bezel 2 with the circuit board 71 (the antenna circuit mounted on the circuit board 71) is described with reference to FIG. 9A to FIG. 9C.

Figure 9A:
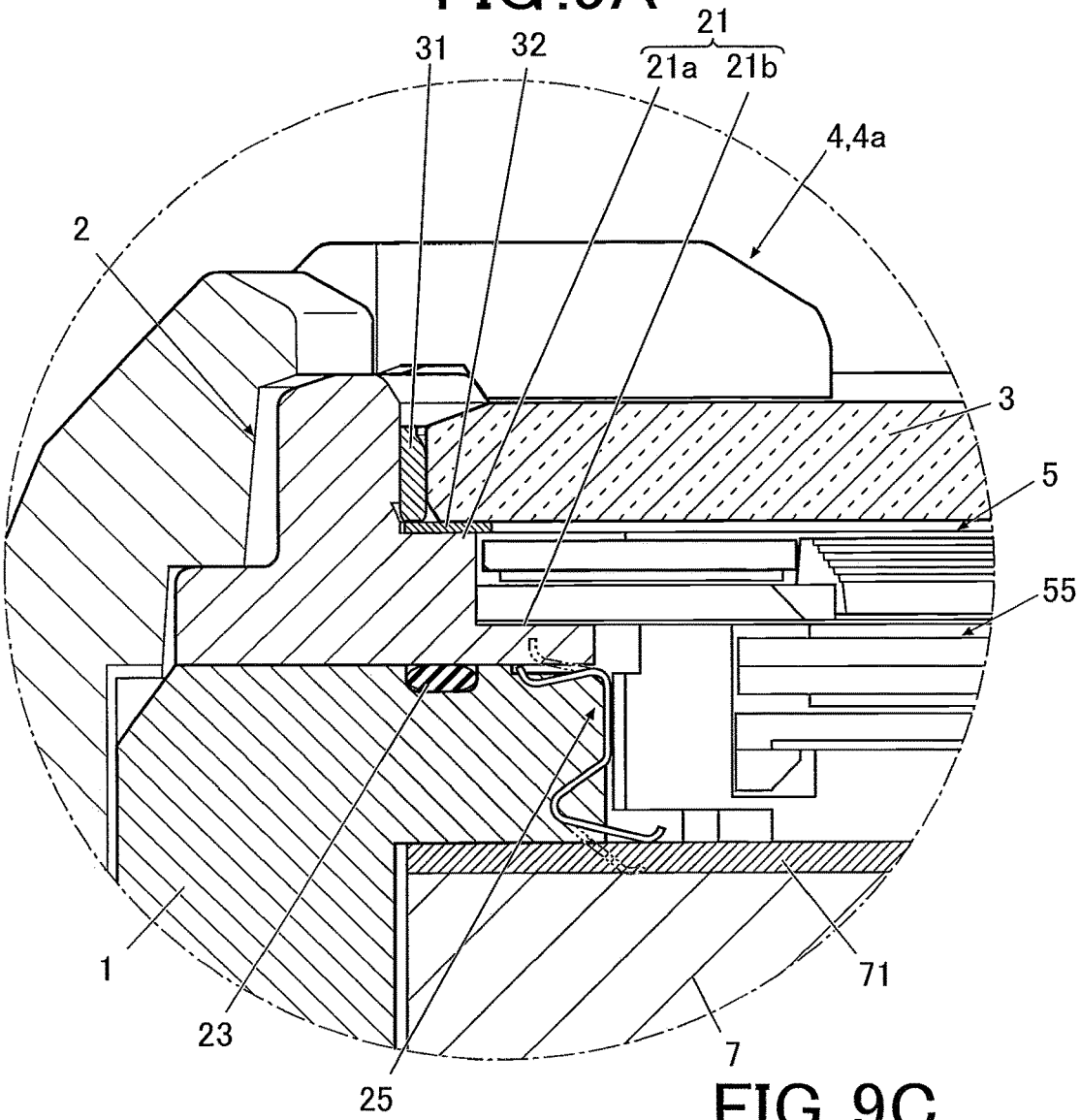
FIG. 9A is an important portion sectional view showing a connection portion where the bezel is connected with a circuit board and its surroundings.

FIG. 9A is an important portion enlarged sectional view showing a connection portion where the bezel 2 is connected with the circuit board 71. FIG. 9B is a perspective view of the connecting member 25 which connects the bezel 2 with the circuit board 71. FIG. 9C is an important portion plan view showing a state in which the connecting member 25 is inserted into the circuit connection hole part 15 of the exterior case 1 viewed from the visible side.

As shown in FIG. 9A, between the bezel 2 and the circuit board 71 of this embodiment, the connecting member 25 is arranged.

The connecting member 25 is a terminal plate formed of a conductive material. Examples thereof include various metal materials. The connecting member 25 is interposed between the bezel 2 and the circuit board 71, so that the bezel 2 and the circuit board 71 are electrically connected with one another.

Figure 9B:
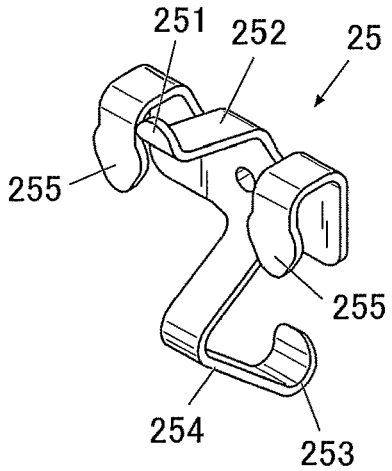
FIG. 9B is a perspective view of a connecting member.

As shown in FIG. 9B, the connecting member 25 has: at one end, a connecting tongue piece 252 having a bezel-side connecting part 251 which is connected to the bezel 2; and at the other end, a connecting leg part 254 having a circuit board-side connecting part 253 which is connected to the circuit board 71. The connecting member 25 also has, at both (right and left) sides of the connecting tongue piece 252, hook parts 255 which are bent toward the connecting leg part 254.

The connecting member 25 is formed, for example, by die-cutting and then bending a thin metal plate in such a way as to form the bezel-side connecting part 251, the connecting tongue piece 252, the circuit board-side connecting part 253, the connecting leg part 254 and the hook parts 255. The whole connecting member 25 has spring properties.

Figure 9C:
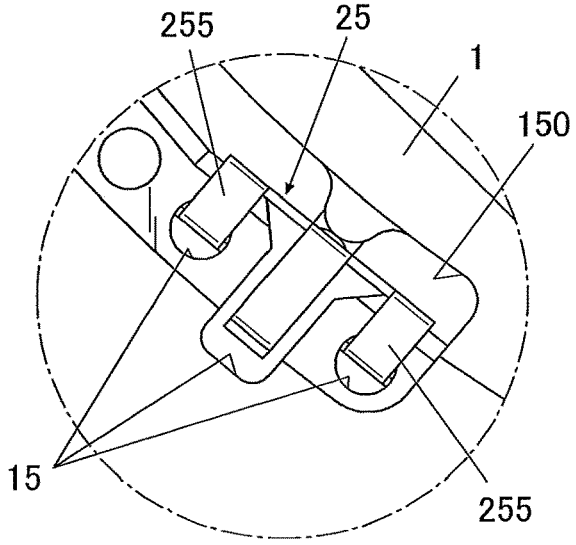
FIG. 9C is an important portion plan view showing a state in which the connecting member is arranged in a circuit connection hole part.

As shown in FIG. 9C, the connecting member 25 is inserted into the notched part 150 of the exterior case 1, and the pair of the hook parts 255 is inserted into one of the circuit connection hole parts 15 from the above (the upper side in FIG. 9A or the bezel 2 side), so that the connecting member 25 is set. Then, from the above the exterior case 1, the bezel 2 is placed, so that the connecting member 25 is interposed between the bezel 2 and the circuit board 71, and its position is fixed.

In FIG. 9A, the connecting member 25 in a state of no application of external force thereto is indicated by a two-dot chain line, and the connecting member 25 in a state of being interposed between the bezel 2 and the circuit board 71 and pressed in the up-down direction (the up-down direction in FIG. 9A or the thickness direction of the exterior case 1) is indicated by a solid line.

As shown in FIG. 9A, the connecting member 25 is arranged between the bezel 2 and the circuit board 71 in a state of being pressed and thereby shrinking as a whole. The bezel-side connecting part 251 is pressed on the back surface (the lower surface in FIG. 9A) of the bezel 2, and the circuit board-side connecting part 253 is pressed on the front surface (the upper surface in FIG. 9A) of the circuit board 71.

Into the ground connection hole part 16, the not-shown ground terminal is inserted to connect the bezel 2 to the ground.

In this embodiment, the circuit board 71 functions as the ground, and one end and the other end of the ground terminal contact the bezel 2 and the circuit board 71, respectively.

The component which functions as the ground is not limited to the circuit board 71. If there is another component which functions as the ground, the ground terminal is arranged such that the other end thereof contacts this component as the ground.

In this way, the bezel 2 formed of a metal material is electrically connected with the circuit board 71 (the antenna circuit mounted on the circuit board 71) and connected to the ground, and consequently can function as an antenna.

Next, the method for adjusting the frequency receivable by the bezel 2 according to this embodiment is described.

As described above, in this embodiment, at least one of (i) the relative permittivity of the dielectric substance which forms the windshield member 3 and (ii) the area of the overlap region where the inward flange part 21 (the first stage flange 21*a* of the bezel 2, in this embodiment) and the windshield member 3 overlap each other is adjusted and set such that the bezel 2 resonates with radio waves having a desired frequency, namely, such that the bezel 2 functions as an antenna which resonates with radio waves having a desired frequency.

In general, if radio waves having a low frequency are desired to be received, an antenna is long. However, in the case where the electronic timepiece 100 having the bezel 2 which is made to function as an antenna is a watch, it is difficult for a normal bezel, which is provided as an exterior member of a watch, to ensure the antenna length for a low frequency, in terms of its size.

In this embodiment, by a combination of the bezel 2 and the windshield member 3 with no change in the size of the bezel 2, the resonance frequency of the bezel 2 is adjusted such that the bezel 2 can receive radio waves having a desired frequency.

The relative permittivity of the dielectric substance which forms the windshield member 3 and the frequency have a relationship in which the higher the relative permittivity of the windshield member 3 is, the lower the frequency of radio waves receivable by the bezel 2 is.

FIG. 10 shows relative permittivity ($\varepsilon_r$) at 1 MHz and dielectric loss ($\tan\delta\times10^{-4}$) at 1 MHz of super white glass and sapphire.

As shown in FIG. 10, super white glass has a relative permittivity of 7 and a dielectric loss of 36, and sapphire (synthetic sapphire) has a relative permittivity of 10 and a dielectric loss of 0.001. Hence, to decrease the frequency of radio waves receivable by the bezel 2 (i.e. to decrease the resonance frequency or resonance point), it is preferable to use sapphire, the relative permittivity of which is higher than that of super white glass, as the material for forming the windshield member 3.

The materials shown in FIG. 10 are examples and do not intend to limit the material for forming the windshield member 3. The material for forming the windshield member 3 can be appropriately selected and used from materials having a high relative permittivity to a low relative permittivity so as to be suitable for the frequency of radio waves desired to be received by the bezel 2.

The bezel 2 and the windshield member 3 have, about arrangement, a relationship in which the wider the area of the overlap region where the inward flange part 21 and the windshield member 3 overlap each other is, the lower the frequency of radio waves receivable by the bezel 2 is.

FIG. 11 is a schematic view to explain the overlap of the bezel 2 and the windshield member 3. FIG. 12 is a graph showing the relationship between the overlap region of the bezel 2 and the windshield member 3 and the frequency.

In FIG. 11, "Gd" represents diameter of the windshield member 3, "BId" represents inner diameter of the inward flange part 21 (the first stage flange 21*a*, in this embodiment) of the bezel 2, and "Bfw" represents width of a ring-shaped portion where the inward flange part 21 (the first stage flange 21*a*, in this embodiment) and the windshield member 3 overlap each other. Further, in FIG. 11, "Ar" indicating a shaded region represents the ring-shaped overlap region where the inward flange part 21 (the first stage flange 21*a*, in this embodiment) and the windshield member 3 overlap each other.

FIG. 12 shows change in the frequency of radio waves receivable by the bezel 2 in a case where the inner diameter BId of the inward flange part 21 shown in FIG. 11 is 38.4 mm, and each of the windshield members 3 having diameters Gd of 39.2 mm (the area of the overlap region Ar is 48.5 $mm^2$), 39.4 mm (the area of the overlap region Ar is 61.1 $mm^2$), 39.6 mm (the area of the overlap region Ar is 73.5 $mm^2$), 39.8 mm (the area of the overlap region Ar is 86 $mm^2$) and 40 mm (the area of the overlap region Ar is 98.5 $mm^2$) is arranged.

As shown in FIG. 12, when the area of the overlap region Ar is small and 48.5 $mm^2$, radio waves having a high frequency of about 1592 MHz can be received, and as the area of the overlap region Ar increases, the frequency of radio waves receivable decreases, and is about 1574 MHz when the area of the overlap region Ar is 98.5 $mm^2$.

Under the above condition, 0.4 mm decrease in the diameter Gd of the windshield member 3 (i.e. 0.2 mm decrease in the width Bfw of the overlap portion) results in about 10 MHz increase in the frequency of radio waves receivable by the bezel 2 (resonance frequency).

Hence, to decrease the frequency of radio waves receivable by the bezel 2 (i.e. to decrease the resonance frequency or resonance point), it is preferable to set the size of the windshield member 3 and/or the width of the inward flange part 21 of the bezel 2 in such a way as to increase the area of the overlap region Ar.

Both of (i) the relative permittivity of the dielectric substance which forms the windshield member 3 and (ii) the area of the overlap region Ar where the inward flange part 21 (the first stage flange 21*a* of the bezel 2, in this embodiment) and the windshield member 3 overlap each other may be adjusted.

In this case, forming the windshield member 3 from a dielectric substance having a high relative permittivity at a size which increases the area of the overlap region Ar allows the bezel 2 to receive radio waves having a lower frequency.

In contrast, forming the windshield member 3 from a dielectric substance having a low relative permittivity at a size which decreases the area of the overlap region Ar allows the bezel 2 to receive radio waves having a higher frequency.

In addition to the region on the back surface of the windshield member 3 placed on the inward flange part 21, the circumferential surface of the windshield member 3 in the thickness direction also contacts the bezel 2.

However, it is considered that the overlap region on the circumferential surface of the windshield member 3 in the thickness direction does not much affect change in the frequency of radio waves receivable by the bezel 2 (resonance frequency). Hence, in FIG. 12, no particular consideration is given thereto.

More specifically, for the change in the frequency (resonance frequency), consideration needs to be given to effective relative permittivity, and what is especially important is degree of overlap of the windshield member 3 on, of the bezel 2, a portion where more current flows. Because more current flows near the ground, in this embodiment where the circuit board 71 serves as the ground, it is considered that more electricity is likely to gather at, of the inward flange part 21, a portion close to the center of the ring-shaped bezel 2 and near the circuit board 71.

Hence, in this embodiment, no consideration is given to the overlap region on the circumferential surface of the windshield member 3 in the thickness direction, and FIG. 12 shows only the relationship indicating change in the frequency (resonance frequency) with respect to the overlap region Ar where the upper surface of the inward flange part 21 contacts the back surface of the windshield member 3.

Factors which can adjust the frequency of radio waves receivable by the bezel 2 are not limited to those described above. The relative permittivity of the windshield member 3 and the overlap region Ar of the windshield member 3 and the bezel 2 may be combined with another/other factor(s) so as to adjust the frequency of radio waves receivable by the bezel 2 more widely.

For example, in this embodiment, between the upper surface of the inward flange part 21 and the back surface of the windshield member 3, the spacer 32 is arranged. The higher the relative permittivity of the material forming the spacer 32 is, the lower the frequency of radio waves receivable by the bezel 2 (resonance frequency) is.

For example, if PET is used as the material for forming the spacer 32 as described above, because the relative permittivity of PET is about 3.2, which is relatively low, the resonance frequency tends to be high. Replacement of the material for forming the spacer 32 with one having a high relative permittivity can promise an effect of making the resonance frequency low.

Further, the thicker the spacer 32 is, the higher the frequency of radio waves receivable by the bezel 2 is.

That is, bringing a component having a possible higher relative permittivity in contact with (or to be contiguous with) the bezel 2 as an antenna can increase the effective relative permittivity, and consequently can produce the same or similar effect as or to that produced by increasing the area of the overlap region Ar where the bezel 2 and the windshield member 3 overlap each other.

Hence, giving consideration also to the combination of the thickness of the spacer 32 and the material for forming the spacer 32 can more greatly change the frequency of radio waves receivable by the bezel 2 (resonance frequency).

Further, the further away the connecting member 25, which electrically connects the bezel 2 with the circuit board 71, is located from the ground terminal, the higher the frequency of radio waves receivable by the bezel 2 is.

Hence, appropriate determination about into which circuit connection hole part 15 and ground connection hole part 16, the connecting member 25 and the ground terminal are inserted, respectively, can also adjust the frequency of radio waves receivable by the bezel 2 (resonance frequency).

Next, operation of the electronic timepiece 100 according to this embodiment is described.

In assembling of the electronic timepiece 100, first, the dial 5 is arranged such that its outer edge is placed on the second stage flange 21*b* of the inward flange part 21 of the bezel 2, and the dial 5 is fixed thereto with the adhesive member 54, such as a double-sided tape.

Next, the waterproof ring 31 is arranged in the first stage flange 21*a* of the inward flange part 21 of the bezel 2 along the inner side surface of the bezel 2, and also the spacer 32 is arranged on the upper surface of the first stage flange 21*a*, and the windshield member 3 is press-fitted into the bezel 2 from the above.

Next, the first buffer members 4*a*, the second buffer member 4*b* and the third buffer member 4*c* are attached to the outer side of the bezel 2. The first buffer members 4*a* and the bezel 2 are fixed to the exterior case 1 with the screws 41. The second buffer member 4*b* and the third buffer member 4*c* are fixed to the exterior case 1 with the screws 45.

Next, the operation buttons 12 (12*a* and 12*b*) are attached by being inserted into the holes 43 of the first buffer members 4*a* and the through holes 14 of the exterior case 1.

Next, the connecting member 25 is arranged in the notched part 150, and the hook parts 255 of the connecting member 25 are fitted in and fastened to the circuit connection hole part 15. Also, the ground terminal is arranged in the notched part 160 and fitted in and fastened to the ground connection hole part 16.

Next, the housing 7 housing the battery 74 and so forth, the circuit board 71, the liquid crystal panel 55 and so forth are arranged in the exterior case 1, and the opening in the back surface of the exterior case 1 is closed by the back cover member 8.

In this way, the electronic timepiece 100 is complete (i.e. assembled).

In the assembled state, the bezel 2 is electrically connected with the circuit board 71 via the connecting member 25. At the time, between the bezel 2 and the circuit board 71, the connecting member 25, which has spring properties, is pressed and thereby shrinks. This can ensure a sufficient contact pressure, and consequently can surely connect the bezel 2 and the circuit board 71 with one another. Further, in the assembled state, the bezel 2 is connected with the circuit board 71, which functions as the ground in this embodiment, via the ground terminal.

In this way, the bezel 2 formed of a metal material can function as an antenna.

Further, for example, if signals from GPS satellites are desired to be received, (i) the relative permittivity of the material for forming the windshield member 3 arranged in the bezel 2 is given consideration and/or (ii) the area of the overlap region Ar of the bezel 2 and the windshield member 3 is adjusted such that the bezel 2 can resonate with radio waves having a desired frequency, for example, 1575.42 MHz. In this way, the bezel 2 as an antenna can receive radio waves having a desired frequency.

Reception of radio waves having a desired frequency enables acquirement of accurate time information, position information and so forth, and consequently enables correction of, for example, time to be displayed by the electric timepiece 100 to right one as needed.

As described above, according to this embodiment, the electronic timepiece 100 includes: the cylindrical exterior case 1 in which the circuit board 71 where the antenna circuit is formed is housed; the bezel 2 which is formed of a metal material to be ring-shaped, includes the inward flange part 21 that projects from the inner side surface of the ring-shaped bezel 2 toward the center of the ring-shaped bezel 2, is arranged on the outer upper side of the exterior case 1, and is electrically connected with the circuit board 71; and the windshield member 3 which is formed of a transparent dielectric substance, arranged in the bezel 2, and supported by the inward flange part 21, wherein the bezel 2 is configured to function as an antenna which resonates with radio waves having a desired frequency by adjustment of at least one of (i) the relative permittivity of the dielectric substance which forms the windshield member 3 and (ii) the area of the overlap region where the inward flange part 21 and the windshield member 3 overlap each other.

That is, the frequency of radio waves receivable by the bezel 2 (resonance frequency) can be set with no change in the size or shape of the bezel 2.

Hence, limitations in design as a timepiece can be suppressed, and radio waves having a desired frequency can be received well while design quality is maintained.

Further, because the bezel 2 is configured to function as an antenna which resonates with radio waves having a desired frequency by appropriate setting of the relative permittivity of the windshield member 3, the area of the overlap region Ar of the inward flange part 21 and the windshield member 3 and/or the like, the bezel 2 as an antenna can receive the radio waves having the desired frequency. This can realize the electronic timepiece 100 which can acquire accurate time information and position information.

Further, in this embodiment, the frequency of radio waves receivable by the bezel 2 as an antenna can be set at a lower frequency by the relative permittivity of the dielectric substance which forms the windshield member 3 being higher.

Further, in this embodiment, the frequency of radio waves receivable by the bezel 2 as an antenna can be set at a lower frequency by the area of the overlap region Ar where the inward flange part 21 and the windshield member 3 overlap each other being wider.

Further, the bezel 2 of this embodiment is connected with the circuit board 71 via the connecting member 25.

That is, the bezel 2, which functions as an antenna, is connected with the circuit board 71 directly by the connecting member 25. This stabilizes their connection state and can keep excellent antenna characteristics as compared with a case where an antenna is connected with a circuit board indirectly by capacitive coupling.

Further, in this embodiment, the radio waves having the desired frequency receivable by the bezel 2, which functions as an antenna, include radio waves transmitted from satellites.

The bezel 2 is configured to resonate with radio waves having, for example, a frequency of 1575.42 MHz by appropriate setting of the size, shape, forming material and/or the like of the bezel 2, and consequently can receive radio waves transmitted from GPS (Global Positioning System) satellites and radio waves transmitted from QZSS, which are quasi-zenith satellites of Japan. This allows the electronic timepiece 100 to make use of time information and position information contained in these radio waves.

One or more embodiments of the present invention are described above. Needless to say, however, the present invention is not limited to the embodiment(s) and can be modified in a variety of aspects without departing from the scope of the present invention.

For example, the configuration to connect the bezel 2 with the circuit board 71 is not limited to that exemplified in the embodiment. For example, a coaxial cable or a feed pin may be used therefor.

Further, the electronic timepiece 100 may include a solar panel.

In this case, the solar panel is also arranged at a position relatively close to the bezel 2, which functions as an antenna. Hence, it is preferable that consideration be also given to, for example, the relative permittivity of the material for forming the solar panel so as to be suitable for the frequency of radio waves desired to be received by the bezel 2.

Further, in the embodiment, the circuit board 71 serves as the ground. However, the ground to which the bezel 2, which functions as an antenna, is connected is not limited to the circuit board 71.

For example, if the dial 5 is formed of a metal material or the like, the dial 5 may function as the ground. In this case, one end and the other end of the ground terminal are connected to the bezel 2 and the dial 5, respectively.

Further, if the electronic timepiece 100 includes the solar panel as described above, the solar panel may function as the ground.

Further, in the embodiment, the electronic timepiece 100 includes the digital display constituted of the liquid crystal panel 55 or the like. However, the display arranged in the electronic timepiece 100 is not limited to such a digital display. For example, the display may be an analog display having hands or the like, or may be an analog-digital display.

Further, in this embodiment, the electronic timepiece 100 is a watch, but not limited thereto. The electronic timepiece of the present invention is applicable to a wide range of devices as far as they can be used as a timepiece.

For example, the electronic timepiece of the present invention may be applied to various devices including a pedometer, an altimeter and a barometer.

In the above, one or more embodiments of the present invention are described. However, the scope of the present invention is not limited thereto, and includes the scope of claims below and the scope of their equivalents.

What is claimed is:

1. A method for manufacturing an electronic device, comprising:

providing a cylindrical exterior case in which a circuit board is housed;

forming a bezel of a metal material to be ring-shaped, the bezel being formed to include an inward flange part that projects from an inner side surface of the ring-shaped bezel toward a center of the ring-shaped bezel by a predetermined distance, wherein said forming the bezel comprises forming the bezel such that the inward flange part includes a first stage flange and a second stage flange which is formed on a further lower side than the first stage flange and projects further toward the center of the bezel than the first stage flange, the first stage flange projecting from the inner side surface of the bezel by the predetermined distance;

arranging the bezel on an outer upper side of the exterior case;

electrically connecting the bezel with the circuit board via a connecting member that contacts the circuit board and a lower surface of the second stage flange;

forming a windshield member of a transparent dielectric substance having a predetermined relative permittivity, the windshield member being formed to have a predetermined diameter;

arranging in the bezel on an upper surface of the first stage flange so that the windshield member is supported by the first stage flange, such that the windshield member and the first stage flange of the inward flange part overlap each other to form an overlap region having a predetermined area that is determined by the predetermined distance and the predetermined diameter;

configuring the bezel to have a predetermined resonance frequency such that the bezel resonates with a radio wave having a predetermined frequency corresponding to the predetermined resonance frequency, wherein said configuring comprises setting the predetermined resonance frequency of the bezel of based on (i) the relative permittivity of the dielectric substance which forms the windshield member and (ii) the area of the overlap region where the first stage flange of the inward flange part and the windshield member overlap each other, wherein the dielectric substance is formed of a material having the predetermined relative permittivity and the windshield member and the inward flange part are arranged such that the area of the overlap region is set to be the predetermined area, the predetermined relative permittivity and the predetermined area of the overlap region being set such that the bezel is configured to have the predetermined resonance frequency.

2. The method for manufacturing an electronic device according to claim 1, wherein the method further comprises one of:

(A) forming the windshield member of a first dielectric substance as the transparent dielectric substance, the first dielectric substance having a first predetermined relative permittivity as the predetermined relative permittivity, to thereby set a first predetermined resonance frequency as the predetermined resonance frequency; and (B) forming the windshield member of a second dielectric substance as the transparent dielectric substance, the second dielectric substance having, as the predetermined relative permittivity, a second predetermined relative permittivity that is higher than the first predetermined relative permittivity, to thereby set, as the predetermined resonance frequency, a second predetermined resonance frequency that is lower than the first predetermined resonance frequency.

3. The method for manufacturing an electronic device according to claim 2, wherein the method further comprises one of:

(C) forming the bezel and the windshield member and arranging the windshield member in the bezel such that the area of the overlap region is set to be a first predetermined area as the predetermined area, the windshield member being formed of the first dielectric substance, to thereby set the predetermined resonance frequency to be the first predetermined resonance frequency; and (D) forming the bezel and the windshield member and arranging the windshield member in the bezel such that the area of the overlap region where the inward flange part and the windshield member overlap each other is set to be a second predetermined area as the predetermined area, the second predetermined area being wider than the first predetermined area, the windshield member being formed of the second dielectric substance, to thereby set the predetermined resonance frequency to be the second predetermined resonance frequency that is lower than the first predetermined resonance frequency.

4. The method for manufacturing an electronic device according to claim 3, wherein the radio wave having the predetermined frequency includes a radio wave transmitted from a satellite.

5. The method for manufacturing an electronic device according to claim 2, wherein the radio wave having the predetermined frequency includes a radio wave transmitted from a satellite.

6. The method for manufacturing an electronic device according to claim 1, wherein the method further comprises one of:

(A) forming the bezel and the windshield member and arranging the windshield member in the bezel such that the area of the overlap region is set to be a first predetermined area as the predetermined area, to thereby set the predetermined resonance frequency to be a first predetermined resonance frequency; and (B) forming the bezel and the windshield member and arranging the windshield member in the bezel such that the area of the overlap region where the inward flange part and the windshield member overlap each other is set to be a second predetermined area as the predetermined area, the second predetermined area being wider than the first predetermined area, to thereby set the predetermined resonance frequency to be a second predetermined resonance frequency that is lower than the first predetermined resonance frequency.

7. The method for manufacturing an electronic device according to claim 6, wherein the radio wave having the predetermined frequency includes a radio wave transmitted from a satellite.

8. The method for manufacturing an electronic device according to claim 1, wherein the radio wave having the predetermined frequency includes a radio wave transmitted from a satellite.

9. A method for manufacturing an electronic device, comprising:

providing a cylindrical exterior case in which a circuit board is housed;

forming a bezel of a metal material to be ring-shaped, the bezel being formed to include an inward flange part that projects from an inner side surface of the ring-shaped bezel toward a center of the ring-shaped bezel by a predetermined distance, wherein said forming the bezel comprises forming the bezel such that the inward flange part includes a first stage flange and a second stage flange which is formed on a further lower side than the first stage flange and projects further toward the center of the bezel than the first stage flange, the first stage flange projecting from the inner side surface of the bezel by the predetermined distance;

arranging the bezel on an outer upper side of the exterior case;

electrically connecting the bezel with the circuit board via a connecting member that contacts the circuit board and a lower surface of the second stage flange;

forming a windshield member of a transparent dielectric substance having a predetermined relative permittivity, the windshield member being formed to have a predetermined diameter; and arranging the windshield member in the bezel on an upper surface of the first stage flange so that the windshield member is supported by the first stage flange, such that the windshield member and the first stage flange of the inward flange part overlap each other to form an overlap region having a predetermined area that is determined by the predetermined distance and the predetermined diameter.

* * * * *